US009340967B2

(12) United States Patent
Daenen

(10) Patent No.: US 9,340,967 B2
(45) Date of Patent: May 17, 2016

(54) KIT INCLUDING SELF-SUPPORTING PANELS FOR ASSEMBLING A MODULAR STRUCTURE

(71) Applicant: Luke Daenen, Detroit, MI (US)

(72) Inventor: Luke Daenen, Detroit, MI (US)

( * ) Notice: Subject to any disclaimer, the term of this patent is extended or adjusted under 35 U.S.C. 154(b) by 0 days.

(21) Appl. No.: 14/158,265

(22) Filed: Jan. 17, 2014

(65) Prior Publication Data

US 2015/0204060 A1 Jul. 23, 2015

(51) Int. Cl.
*E04B 1/32* (2006.01)
*A63H 33/08* (2006.01)

(52) U.S. Cl.
CPC ..... *E04B 1/3211* (2013.01); *A63H 33/084* (2013.01); *E04B 2001/3276* (2013.01); *E04B 2001/3294* (2013.01); *Y10S 52/10* (2013.01)

(58) Field of Classification Search
CPC ..... E04B 1/3211; E04B 2001/3276; E04B 2001/3288; E04B 7/028; E04B 1/19; E04B 2001/3294; A63H 33/16; A63H 33/08; A63H 33/04; A63H 33/06; A63H 33/084; A63H 33/105; A63H 33/086; Y10S 52/10
See application file for complete search history.

(56) References Cited

U.S. PATENT DOCUMENTS

| | | | | | |
|---|---|---|---|---|---|
| 1,292,188 | A | * | 1/1919 | Wheeler | 446/85 |
| 2,776,521 | A | * | 1/1957 | Zimmerman | 446/115 |
| 3,296,767 | A | * | 1/1967 | Lebowitz | 52/634 |
| 3,562,077 | A | * | 2/1971 | Raba | A47B 95/04 362/352 |
| 3,666,607 | A | * | 5/1972 | Weissman | B65D 5/008 229/108 |
| 4,012,872 | A | | 3/1977 | Stolpin | |
| 4,454,678 | A | | 6/1984 | Duvivier | |
| 4,611,441 | A | * | 9/1986 | Wickens | 52/81.4 |
| 4,655,019 | A | | 4/1987 | Rejc | |
| 4,719,726 | A | | 1/1988 | Bergman | |
| 4,723,382 | A | * | 2/1988 | Lalvani | 52/81.1 |
| 4,903,441 | A | * | 2/1990 | Nierle | 52/79.4 |
| 4,907,382 | A | * | 3/1990 | Schwam | 52/81.1 |
| 4,976,652 | A | * | 12/1990 | Schwartz | 446/488 |
| 5,020,287 | A | * | 6/1991 | Woods | E04B 7/102 52/80.2 |
| 5,104,125 | A | * | 4/1992 | Wilson | 273/157 R |
| 5,168,677 | A | * | 12/1992 | Pronsato | A63F 9/1208 52/81.1 |
| 5,205,556 | A | * | 4/1993 | Stallman | 273/157 R |
| 5,253,799 | A | * | 10/1993 | Sebesta | 229/108 |
| 5,281,185 | A | * | 1/1994 | Lee | 446/488 |
| 5,400,918 | A | * | 3/1995 | Prodaniuk | 220/677 |
| 5,489,230 | A | * | 2/1996 | Gavula, Jr. | 446/109 |
| 5,662,508 | A | * | 9/1997 | Smith | 446/128 |
| 5,895,045 | A | * | 4/1999 | Vilar | 273/160 |
| 5,895,306 | A | * | 4/1999 | Cunningham | 446/108 |
| 6,076,318 | A | * | 6/2000 | Grimm et al. | 52/245 |
| 6,082,056 | A | * | 7/2000 | Hoberman | 52/81.5 |

(Continued)

OTHER PUBLICATIONS

"Pickets Toy" Small Worls Toys Sep. 27, 2013. Available at: http://shop.smallworldtoys.com/product_p/9729310.htm.

(Continued)

*Primary Examiner* — James Ference
(74) *Attorney, Agent, or Firm* — Wayne State University Patent Procurement Clinic; David Berry

(57) ABSTRACT

Panels can join to form a structural module via slotting, abutment, and rotational symmetry. The slots allow for assembly without additional fastening. Modules can range in shape and size, while conforming to the interlocking configuration between the panels. Panels can be joined to form various structures with similar connective features. The panel's combinability via the slots makes possible many structural forms and re-configurable applications.

20 Claims, 9 Drawing Sheets

(56) References Cited

U.S. PATENT DOCUMENTS

| | | | | |
|---|---|---|---|---|
| 6,098,347 | A * | 8/2000 | Jaeger et al. | 52/81.3 |
| 6,152,797 | A * | 11/2000 | David | 446/115 |
| 6,173,538 | B1 * | 1/2001 | Fleishman | 52/81.4 |
| 6,179,681 | B1 * | 1/2001 | Matos | 446/116 |
| 6,658,800 | B2 | 12/2003 | Monson | |
| 6,711,860 | B2 * | 3/2004 | Fleishman | 52/81.3 |
| 6,834,465 | B2 * | 12/2004 | Hoberman | 52/3 |
| 6,895,722 | B1 * | 5/2005 | Ponder | 52/578 |
| 6,931,812 | B1 * | 8/2005 | Lipscomb | 52/653.1 |
| 6,935,075 | B2 * | 8/2005 | Sherman | 52/79.1 |
| 7,036,277 | B2 * | 5/2006 | Burginger | 52/79.4 |
| 7,434,359 | B2 | 10/2008 | Geiger | |
| 7,833,077 | B1 * | 11/2010 | Simmons, Jr. | 446/85 |
| 2002/0078653 | A1 * | 6/2002 | Jean | 52/578 |
| 2004/0250494 | A1 * | 12/2004 | Osiatinskiy et al. | 52/582.1 |
| 2005/0014441 | A1 * | 1/2005 | Matos | 446/85 |
| 2006/0099375 | A1 * | 5/2006 | Lee | A63H 33/04 428/53 |
| 2010/0178839 | A1 * | 7/2010 | Khattah Omar | 446/120 |
| 2011/0036040 | A1 * | 2/2011 | Child | 52/588.1 |
| 2011/0107706 | A1 * | 5/2011 | Fleishman | 52/574 |
| 2012/0270463 | A1 * | 10/2012 | Ziegler | 446/85 |
| 2013/0330998 | A1 * | 12/2013 | Fox et al. | 446/124 |

OTHER PUBLICATIONS

"iQlight" Holger Strom. Nov. 30, 2013. Available at http://www.iqlight.com/.

* cited by examiner

KIT INCLUDING SELF-SUPPORTING PANELS FOR ASSEMBLING A MODULAR STRUCTURE

FIELD OF THE INVENTION

The field to which the invention generally relates is static structures formed of single self-supporting panels.

BACKGROUND

Static structures formed from single self-supporting panels attachable to one another via one or more separate connecting means to form a structure are generally known in the art as shown in U.S. Pat. No. 4,719,726 and U.S. Pat. No. 7,434,359. It would be desirable to provide one or more generally planar panels attachable to one another without the need for additional separate connecting means to form a structure for the purpose of reducing the number of required parts for assembly; simplifying construction of a structure; and reducing the cost of manufacturing the structure. It would be desirable to provide a flat pack capability for ease of shipping and storage. It would be desirable for the module to be adaptable to many re-configurable applications. It would be desirable to provide for ease of disassembly and reassembly in a portable configuration, such as kits and as technology for building systems.

SUMMARY

As used herein the term "kit" is used generically to describe a system for building interlocking three dimensional shapes configured from triangular tessellations. A kit for building a structural shape can include at least one planar panel that can include at least three sides. The at least three sides can include a first side that can be a straight edge having a first end and a second end, a second side connected to the first end and extending from the first side at a first angle, and a third side connected to the first end and extending from the first side at a second angle.

The kit can further include a first, a second, and a third planar panel, where each planar panel can include at least three sides and each panel can be either identical in shape and size to one another to form regular modules, or non-identical as long as adjoining edges are equal in length to form irregular modules. The three sides can be straight, curved, or can vary in shape. The at least three sides of each panel can include a first side that can be a straight edge having a first end and a second end, a second side connected to the first end and extending from the first side at a first angle, and a third side connected to the first end and extending from the first side at a second angle. The kit can further include a first connector integrally formed with the first side of each panel and defining a first slot between the first side and the first connector having a first blind end substantially located at the midpoint of the first side. The first slot can be defined to be substantially parallel to the first side. The kit can further include a second connector integrally formed with the second side of each panel defining a second slot having a second blind end between the second side and the second connector. The second slot can be defined to be substantially parallel to the second side. The kit can further include a third connector integrally formed with the third side of each panel defining a third slot having a third blind end between the third side and the third connector. The third slot can be defined to be substantially parallel to the third side.

The second connector and third connector of each planar panel can mechanically engage with one another to define a three dimensional geometric shape, wherein the second slot of the second connector of the first planar panel slidably engages the third slot of the third connector of the second planar panel, the second slot of the second connector of the second planar panel slidably engages the third slot of the third connector of the third planar panel, and the second slot of the second connector of the third planar panel slidably engages the third slot of the third connector of the first planar panel, such that the second blind ends of each of the second slots abuts the third blind end of the third slot to mechanically interconnect the first planar panel, the second planar panel, and the third planar panel with respect to one another, such that a first joint is formed at the intersection of each planar panel and an adjacent planar panel to define at least one substantially tetrahedron-shaped assembled sub-structure hereinafter referred to as a module, which is a basis for a polyhedra, such as a platonic solid.

The at least one module structure can further include a first module structure, a second module structure, a third module structure, a fourth module structure, and a fifth module structure. The first connectors of the first through fifth module sub-structures can mechanically engage one another, such that one of the first blind ends of one of the first slots of the first sub-structure abuts one of the first blind ends of one of the first slots of an adjacent sub-structure, such that the first module sub-structure and the second through fifth adjacent module sub-structure are connectable with respect to one another. If five irregular shaped modules are used, the assembled structure can form at least one substantially pentagon-shaped structure. If six regular shaped modules are used, the assembled structure can form at least one substantially hexagonal-shaped structure. Rotational symmetry can be provided, where if the first slots are oriented in a like direction, the slots will interlock with respect to one another. Twelve pentagonal shaped structures can interlock to create a dodecahedron, which is a platonic solid. A plurality of hexagonal shaped structures can be interconnected but will not define a polyhedra, since the resulting shape is not totally enclosed due to the inclusion of square openings in the assembled structure.

The at least one substantially pentagonal shaped structure can further include a first substantially pentagonal shaped structure and a second substantially pentagonal shaped structure, wherein the first slot of the first connector of the a first substantially pentagonal shaped structure can slidably engage the first slot of the first connector of the a second substantially pentagonal shaped structure, such that the first blind end of each of the first slots abuts the first blind end of the first slot to mechanically interconnect the first substantially pentagonal shaped structure and second substantially pentagonal shaped structure to form at least one assembled modular structural shape.

The slot geometry and vertices of each panel can be modified to define the dimensions of a substantially tetrahedron-shaped module. Adjacent modules can be given identical lengths and touching edges, thus allowing the modules to tessellate and interconnect in such a way that a wide variety of forms can be achieved.

Other embodiments of the present invention will become apparent to those skilled in the art when the following detailed description is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

The terms "substantially", "near", and "about" as used within this application shall be construed to have their ordinary meanings. That is, "substantially", "near", and "about" shall be considered to mean "near, close to, not far from, or otherwise somewhere or something close to" that to which the terms relate.

At least one panel can be either regular or irregular and can make up modules that can be either regular or irregular, and can be fit together to form any triangular network as long as the vertices of adjacent panels and modules are contiguous. The modules allow construction of platonic solid shapes, such as a tetrahedron that can be the basis for a three panel module and the building of larger shapes with a plurality of tetrahedron modules, such as a dodecahedron.

Figure 1A:
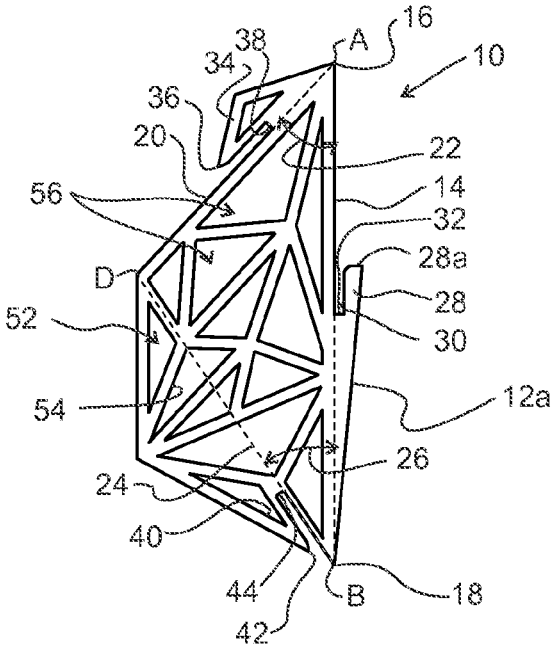
FIGS. 1A-1C are side views of a set of irregularly shaped panels, where each panel has an optional lattice structure formed within an area defined by a peripheral edge, the peripheral edge defines at least a first straight edge, a second edge connected at a first angle with respect to the first edge, and a third edge connected at a second angle with respect to the first edge, and where vertices A-A, B-B, C-C of the set of panels connect to one another to form an assembled module.
Figure 1B:
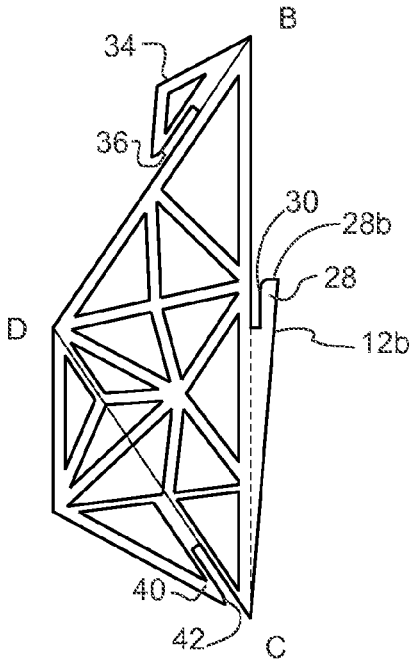
Figure 1C:
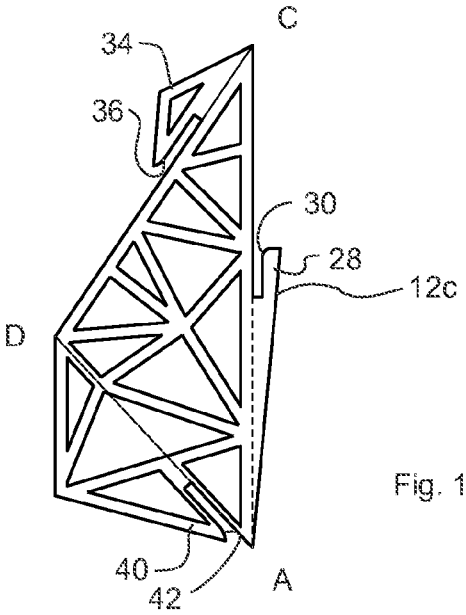

Referring now to FIGS. 1A-1C a kit for building a structural shape 10 can include at least one planar panel 12 having at least three sides. The at least three sides can include a first side 14 formed as a straight edge having a first end 16 and a second end 18, a second side 20 connected to the first end 16 and extending from the first side 14 at a first predetermined angle 22, and a third side 24 connected to the first end 16 and extending from the first side 14 at a second predetermined angle 26.

The second side 20 and third side 24 are defined by lines BD and AD respectively and can include straight edge portions, non-straight edge portions, and any combination thereof. The first side 14, second side 20, and third side 24 can each individually be of length and dimension suitable to define a generally triangular-shape, or generally trapezoidal-shape, of the at least one planar panel 12. The at least three sides can include a fourth side, fifth side, and any number of other sides having straight edge portions, non-straight edge portions and any combination thereof, to define any desired shape extending between the second side 20 and third side 24.

The first predetermined angle 22 can range from a minimum of approximately 10° to a maximum of approximately 160°, inclusive. The first predetermined angle 22 can more preferably range from a minimum of approximately 20° to a maximum of approximately 120°, inclusive. The first predetermined angle 22 can most preferably range from a minimum of approximately 30° to a maximum of approximately 70°, inclusive. The second predetermined angle 26 can range from a minimum of approximately 10° to a maximum of approximately 160°, inclusive. The second predetermined angle 26 can more preferably range from a minimum of approximately 20° to a maximum of approximately 120°, inclusive. The second predetermined angle 26 can most preferably range from a minimum of approximately 30° to a maximum of approximately 70°, inclusive.

Each panel of the kit can include a first connector 28 integrally formed with the first side 14 to define a first slot 30 between the first side 14 and the first connector 28 having a first blind end 32 substantially located at a midpoint of the first side 14, with the first connector 28 having a straight edge between the second end 18 and an outer tip 28*a* of the first connector 28. The first slot 20 can be defined to be substantially parallel to the first side 14. As illustrated in FIG. 1A, the first slot 30 has an open end facing away from the second end 18.

Each panel of the kit can include a second connector 34 integrally formed with the second side 20 to define a second slot 36 having a second blind end 38 between the second side 20 and the second connector 34. The second slot 36 can be defined to be substantially parallel to the second side 20. As illustrated in FIG. 1A, the second slot 36 has an open end facing away from the first end 16.

Each panel of the kit can include a third connector 40 integrally formed with the third side 24 to define a third slot 42 having a third blind end 44 between the third side 24 and the third connector 40. The third slot 42 can be defined to be substantially parallel to the third side 24. As illustrated in FIG. 1A, the third slot 42 has an open end facing toward the second end 18.

Each of the first slot 30, second slot 36, and third slot 42 can be defined, respectively, by the first connector 28, second connector 34, and third connector 40, such that the first slot 30, second slot 36, and third slot 42 are substantially similar in width, such that the width of each slot is substantially similar to the thickness of a planar panel and is capable of slidably engaging another planar panel. The first blind end 32, second blind end 38, and third blind end 44 define the ends of the first slot 30, second slot 36, and third slot 42, respectively.

Referring now to FIGS. 1A-2C, the kit can include a first planar panel 12*a*, a second planar panel 12*b*, and a third planar panel 12*c*, each planar panel 12*a*, 12*b*, 12*c* being non-identical to each other with first, second, and third connectors 28, 34, 40, slots 30, 36, 42, and blind ends 32, 38, 44, respectively. As best seen in FIG. 2A, the second connector 34 and third connector 40 of each planar panel 12*a*, 12*b*. 12*c* can mechanically engage with one another to define a three dimensional geometric shape, wherein the second slot 36 of the second connector 34 of the first planar panel 12*a* operably engages with the third slot 42 of the third connector 40 of the second planar panel 12*b* to define a first sliding joint. The first sliding joint can be formed by slidably engaging the second connector 34 and second slot 36 of the first planar panel 12*a* with the third connector 40 and third slot 42 of the second planar panel 12*b*, such that the second blind end 38 of the first planar panel 12*a* abuts the third blind end 44 of the third slot 42 of the second planar panel 12*b*, such that the second slot 36 is filled with the third connector 40, the third slot 42 is filled with the second connector 34, a portion of the third connector 40 overlies the second connector 34, and a portion of the second connector 34 overlies the third connector 40. As best seen in FIG. 2A, the kit can include at least one planar panel 12, and more particularly can include a first planar panel 12*a*, a second planar panel 12*b*, and a third planar panel 12*c*.

Figure 10A:
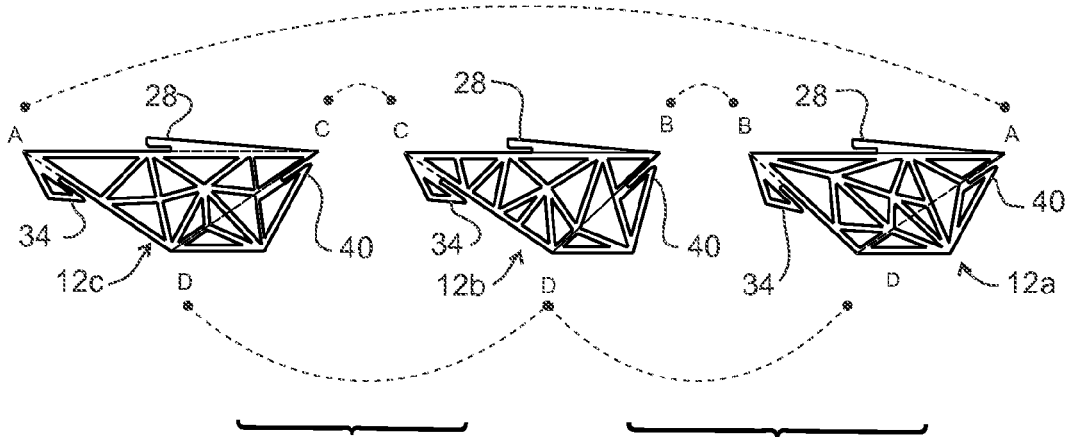
FIG. 10A illustrate a method or process for assembling a module from either regular or irregular shaped panels that fit together to form a triangular network as long as the vertices are contiguous.

Referring now to FIGS. 1A-2C, and 10A, the second connector 34 and third connector 40 of each planar panel 12*a*, 12*b*, 12*c* can mechanically engage with one another to define a three dimensional geometric shape, i.e. vertex A of FIG. 1A connected to vertex A of FIG. 1C; vertex B of FIG. 1A connected to vertex B of FIG. 1B; and vertex C of FIG. 1B connected to vertex C of FIG. 1C. In this way, the planar panels 12*a*, 12*b*, and 12*c*, come together at vertex D of each panel. The three dimensional geometric shape of FIG. 2A is defined by assembling the panels as shown in FIG. 10A with the second slot 36 of the second connector 34 of one of the planar panels 12*a*, 12*b*, 12*c* slidably engaging the third slot 42 of the third connector 40 of another adjacent one of the planar panels 12*a*, 12*b*, 12*c*. The second blind end 38 of the second slot 36 abuts against the third blind end 44 of the third slot 42 to mechanically interconnect the first, second and third planar panels 12*a*, 12*b*, 12*c* with respect to one another, such that a first joint is formed at the intersection of each planar panel and an adjacent planar panel.

As best seen in FIGS. 1A-1C, the kit can include a surface area 52 bounded by a first side 14, a second side 20, and a third side 24. The surface area 52 can be formed with an optional lattice structure 54 defining a plurality of apertures 56. The surface area 52 can be bound and defined by a fourth side, a fifth side, or any number of other sides with straight portion, non-straight portions, or any combination thereof to define a peripheral edge of each planar panel. The lattice structure 54 can be disposed within the surface area and can define a plurality of apertures 56. The lattice structure can be webbing, a plurality of cross-hatched members, and any combination of generally elongated members extending between at least the first side, the second side, and the third side and define a plurality of apertures 56. The planar panel can be formed with a generally planar solid body extending between at least the first side, the second side, and the third side without any apertures. A void or aperture can be defined and bound by at least the first side, the second side, and the third side. The lattice structure 54 can provide aesthetic value, structural support, and other desired characteristics to each planar panel.

The kit can include a first planar panel 12*a* and a second planar panel 12*b*. The second connector 34 of the first planar panel 12*a* can be connectable to the third connector 40 of the second planar panel 12*b* to form a first slidable joint. When assembled in a different configuration, the first connector 28 of the first planar panel 12*a* can be connectable to the first connector 28 of the second planar panel 12*b* to form a second slidable joint.

One of ordinary skill in the art will appreciate that while the first and second slidable joints do not require additional fastening or connecting means to ensure that first, second, or third planar panels remain operatively engaged to one another, the inclusion of additional connecting means, although not required, remains within the spirit and scope of the present invention.

The kit can further include a first, a second and a third planar panel 12*a*, 12*b*, and 12*c*. Each planar panel can have at least three sides. The first side 14 can include a straight edge with a first end 16 and a second end 18. The second side 20 can be connected to the first end 16 and extend from the first side 14 at a first predetermined angle 22. The third side 24 can be connected to the second end 18 and extend from the first side 14 at a second predetermined angle 26.

The kit can further include a first connector 28 integrally formed with the first side 14. The first connector 28 can define a first slot 30 between the first side 14 and the first connector 28. The first slot 30 can have a first blind end 32 substantially located at the midpoint of the first side 14. The first slot 20 can be defined to be extending substantially parallel to the first side 14.

The kit can further include a second connector 34 integrally formed with the second side 20. The second connector 34 can define a second slot 36 having a second blind end 38 between the second side 20 and the second connector 34. The second slot 36 can be defined to be extending substantially parallel to the second side 20.

The kit can further include a third connector 40 integrally formed with the third side 24 defining a third slot 42. The third slot 42 can have a third blind end 44 between the third side 24 and the third connector 40. The third slot 42 can be defined to be extending substantially parallel to the third side 24.

Figure 8:
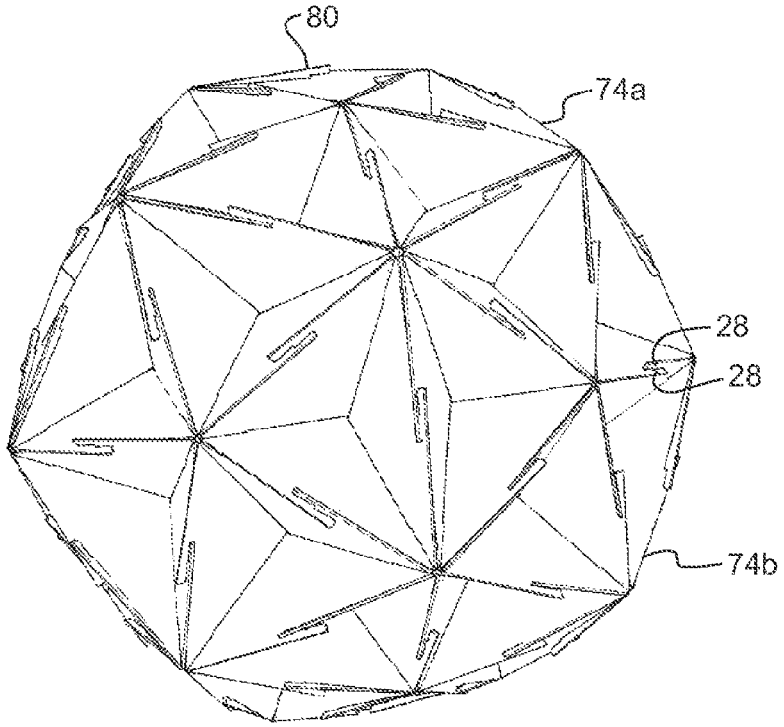
FIG. 8 is a simplified perspective view of an assembled modular structure formed of a plurality of generally pentagonal shaped modular structures as illustrated in FIG. 7, where the tetrahedron-shaped modular structures are formed from a plurality of irregular panels.
Figure 9A:
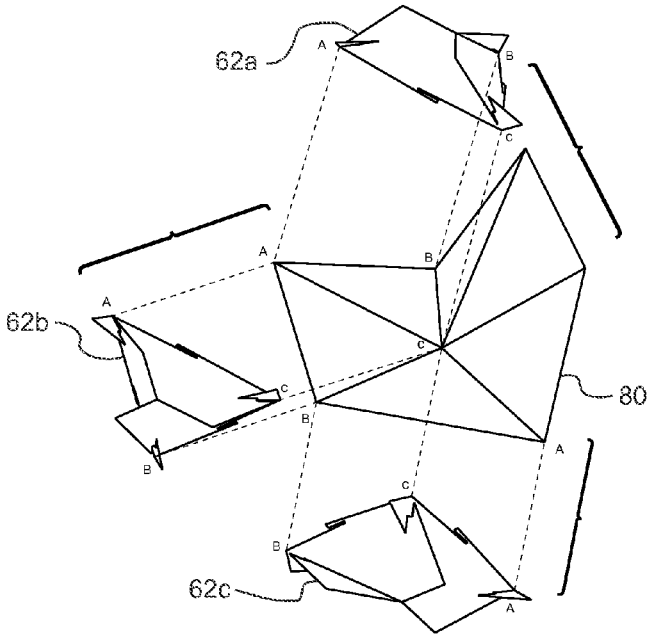
FIGS. 9A-9C illustrate the use of tetrahedron-shaped modular structures for assembling a larger superstructure.
Figure 9B:
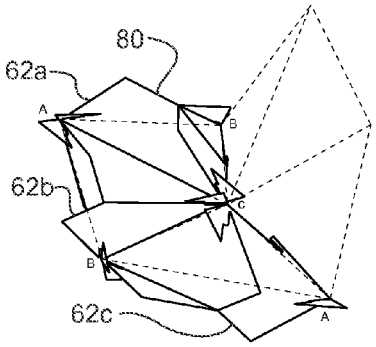
Figure 9C:
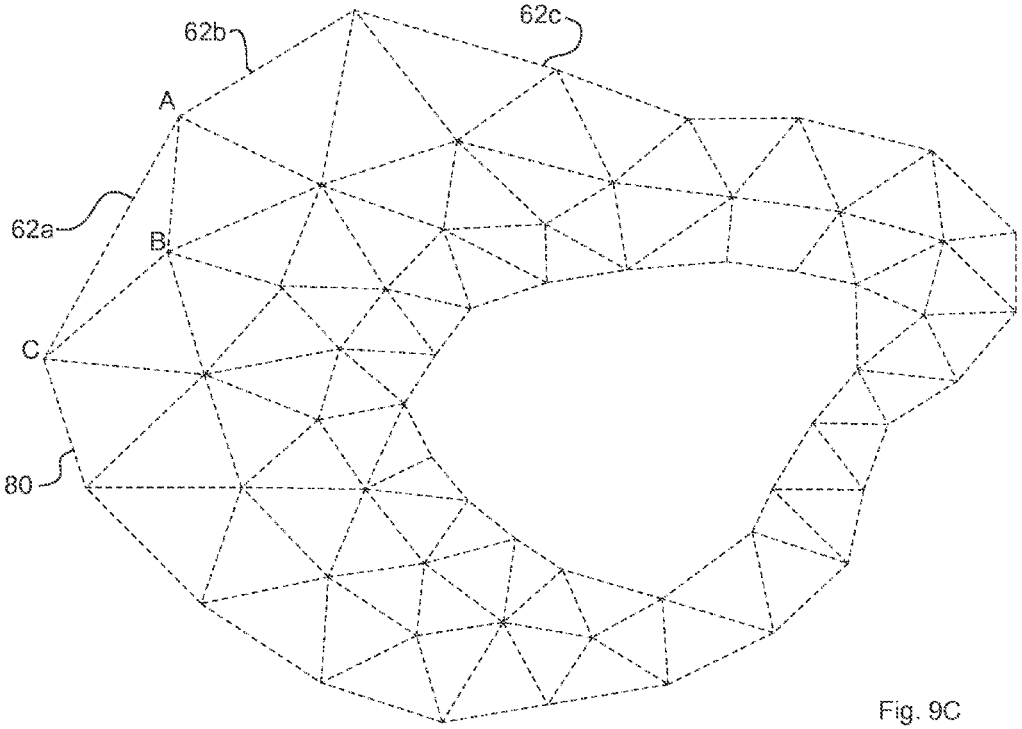

Referring to FIGS. 3A-3B and 4A-4C a planar panel 12 can form a regular equilateral panel from line A-B, A-D, and B-D. The planar panel 12 can include a first connector 28, second connector 34, and third connector 40. Three panels of identical dimensions formed by lines AB, AD, and BD can make up three panels 12*a*, 12*b*, and 12*c* that can be assembled into a module 62 and further assembled into a larger superstructure 80, as seen in FIG. 8, in the same manner as described with respect to the irregular panels of FIGS. 1A-1C and 10A-10B. Alternatively, three panels of non-identical dimensions formed by lines AB, AD, and BD can make up three panels 12*a*, 12*b*, and 12*c* that can be assembled into a module 62 and further assembled into a larger superstructure 80, as seen in FIG. 8, in the same manner as described with respect to the irregular panels of FIGS. 1A-1C and 10A-10B.

Figure 4A:
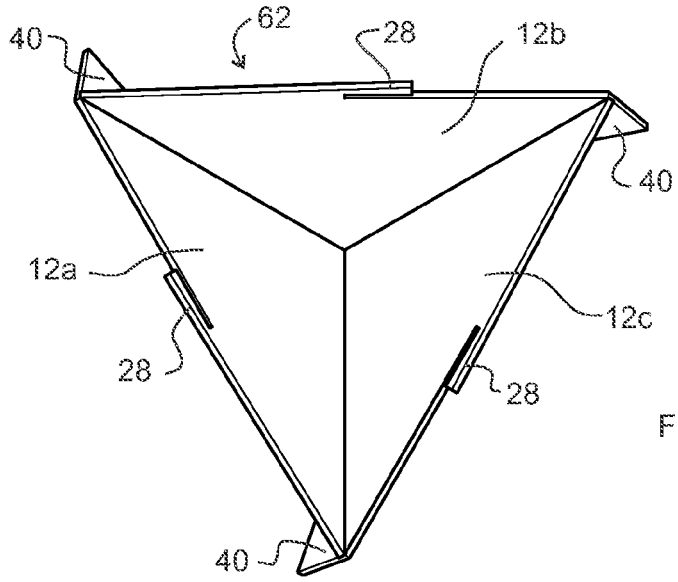
FIGS. 4A-4C illustrate a kit of three regular equilateral panels of FIGS. 3A-3B including a first planar panel, a second planar panel, and a third planar panel, where each planar panel is identical to each other with first, second, and third connectors slots and blind ends respectively for assembly into a module through interconnection of connectors A-A, B-B, C-C.
Figure 4B:
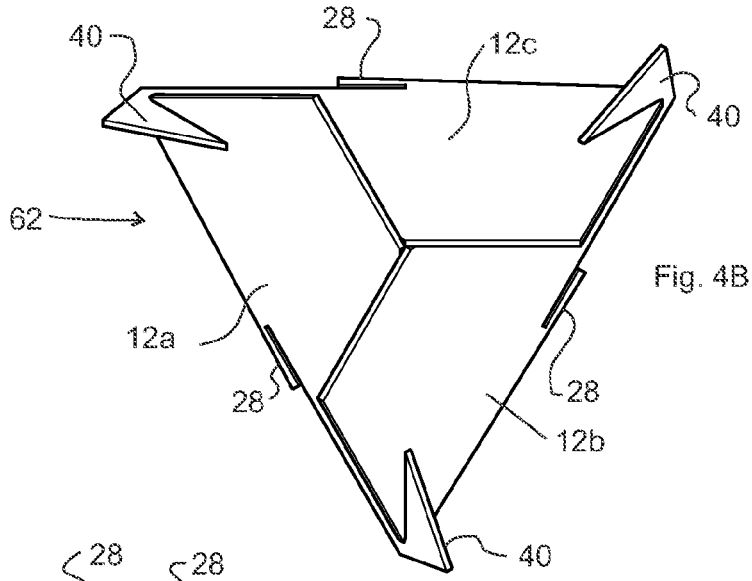
Figure 4C:
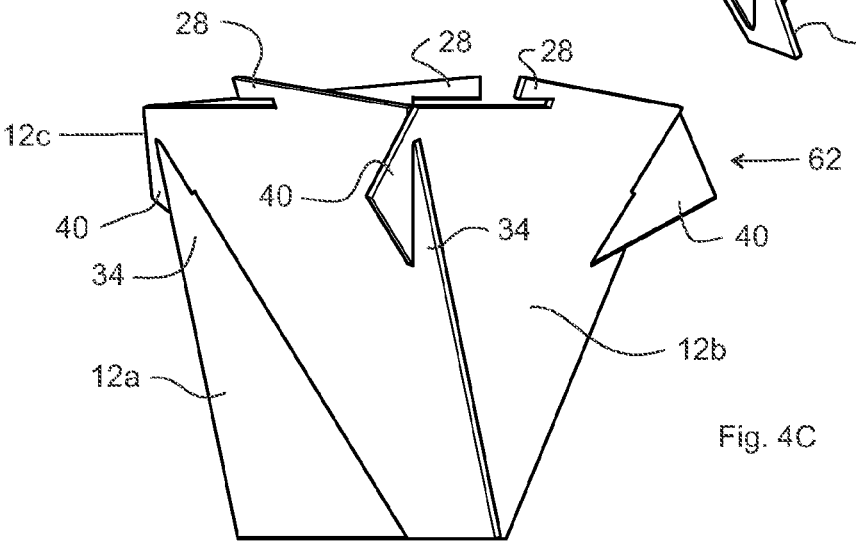

The kit can include a first planar panel 12*a* and a second planar panel 12*b*, and a third planar panel 12*c*, each planar panel 12*a*, 12*b*, 12*c* with first, second, and third connectors slots and blind ends respectively. As best seen in FIG. 4A, the second connector 34 (vertex A) and third connector 40 (vertex B) of each adjacent planar panel 12*a*, 12*b*, and 12*c* can mechanically engage with one another to define a three dimensional geometric shape 62, wherein the second slot of the second connector 34 of the first planar panel 12*a* operably engages with the third slot of the third connector 40 of the second planar panel 12*b* to define a first sliding joint. The second connector 34 and third connector 40 of each planar panel 12*a*, 12*b*, 12*c* can mechanically engage with one another to define a three dimensional geometric shape 62. The three dimensional geometric shape 62 is defined with the second slot of the second connector 34 of one of the planar panels 12*a*, 12*b*, 12*c* slidably engaging the third slot of the third connector 40 of another adjacent one of the planar panels 12*a*, 12*b*, and 12*c*. The first connector 28 of each planar panel 12*a*, 12*b*, and 12*c* can mechanically engage with other first connectors 28 of an additional three dimensional geometric shape 62.

Figure 5A:
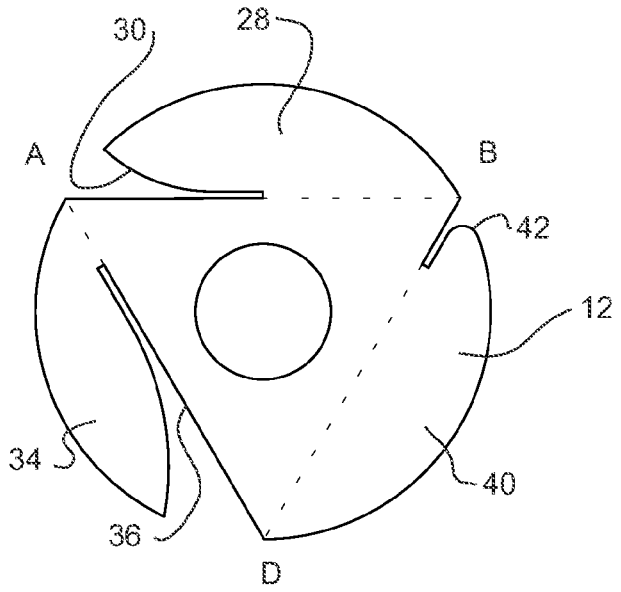
FIGS. 5A and 5B illustrate a planar panel forming a regular equilateral panel from line A-B, A-D, and B-D, where the first, second, and third connectors can have a curved outer edge.
Figure 5B:
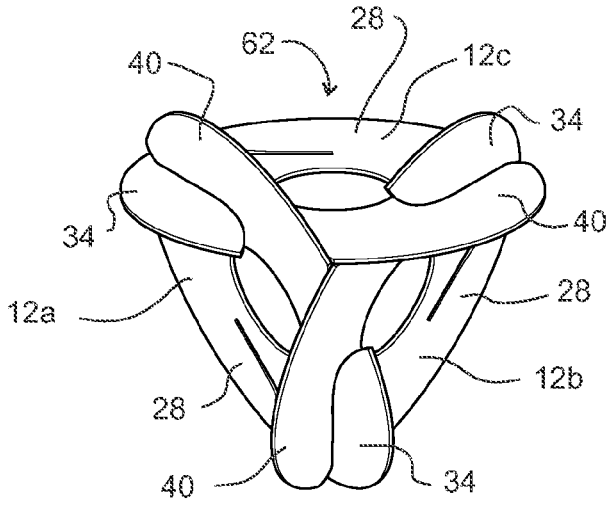

Referring to FIGS. 5A and 5B, a planar panel 12 can form a regular equilateral triangle from line A-B, A-D, and B-D where the first 28, second 34, and third connectors 40 can have a curved edge or an edge defining a compound curve. A first, second, and third planar panel 12*a*, 12*b*, and 12*c* can be joined in a similar fashion as described according to FIGS. 4A, 4B, and 4C to define a three dimensional geometric shape 62.

Figure 2A:
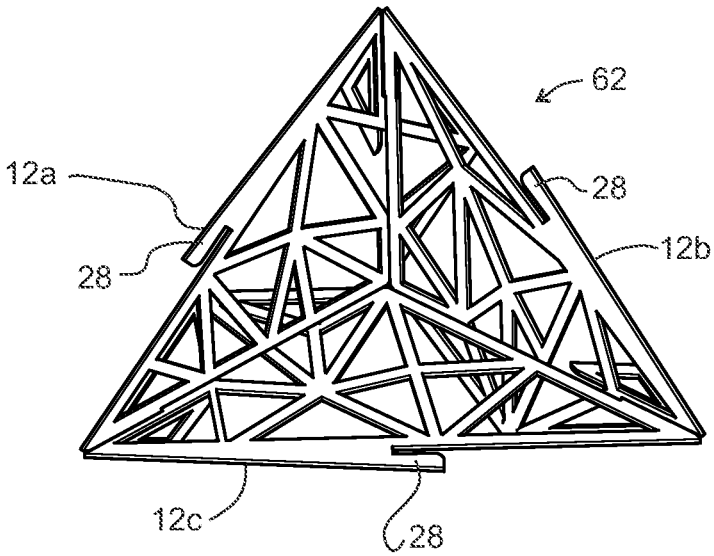
FIG. 2A is a plan view of an assembled generally tetrahedron-shaped modular structure formed of first, second, and third panels as illustrated in FIG. 1A-1C with three panels forming a three sided receptacle with an irregular triangular open end.
Figure 2B:
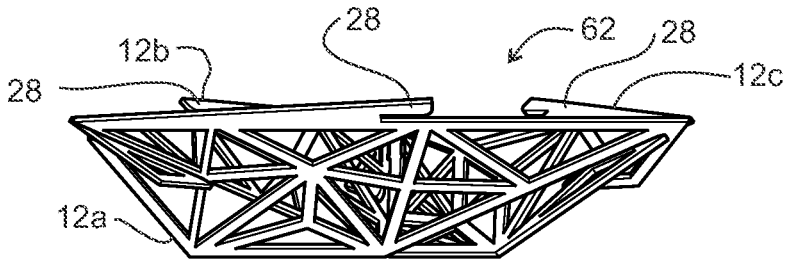
FIG. 2B is a side view of the assembled generally tetrahedron-shaped modular structure illustrated in FIG. 2A and formed of first, second, and third panels as illustrated in FIGS. 1A-1C.
Figure 2C:
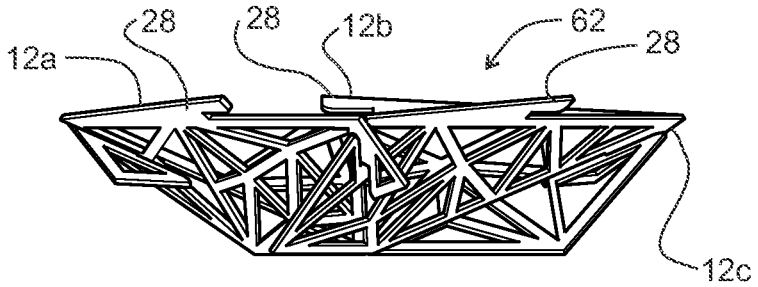
FIG. 2C is a rotated side elevational view of the assembled generally tetrahedron-shaped modular structure as illustrated in FIGS. 2A-2B and formed of first, second, and third identical panels as illustrated in FIGS. 1A-1B illustrating a vertices joint between adjacent panels.
Figure 3A:
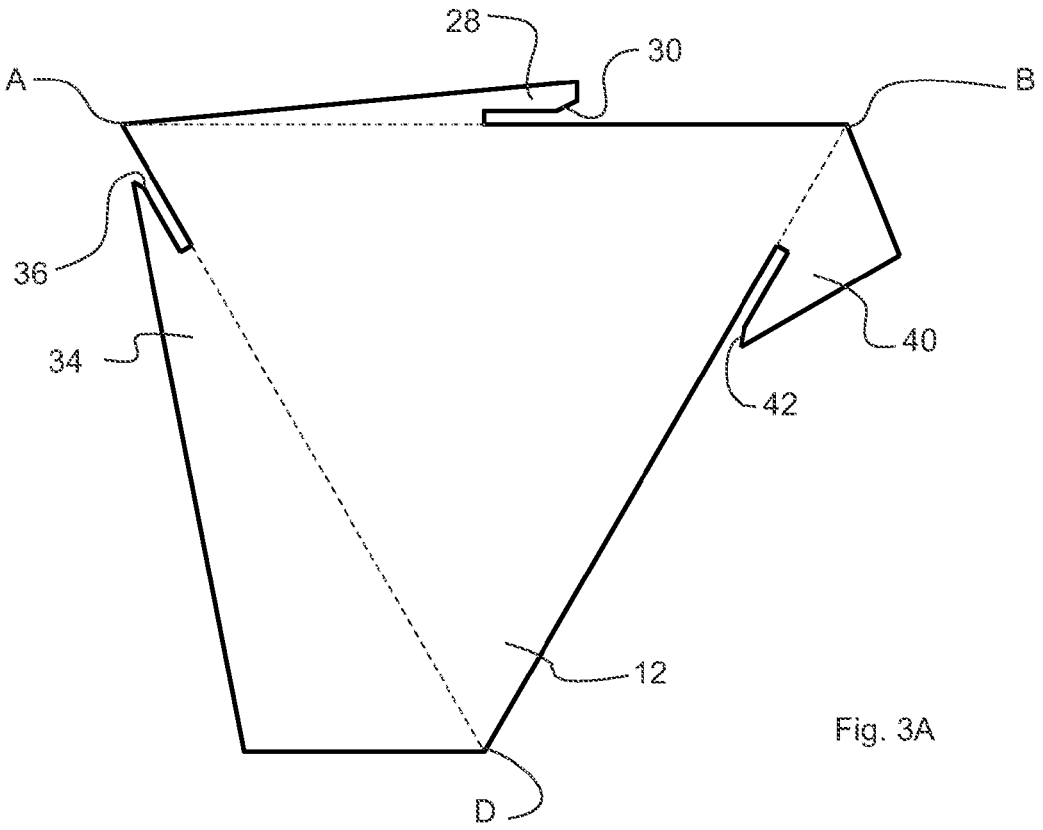
FIGS. 3A and 3B illustrate a planar panel forming a regular equilateral panel from line A-B, A-D, and B-D without optional lattice structure.
Figure 3B:
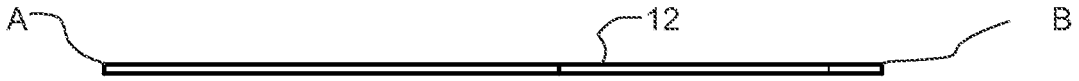
Figure 6:
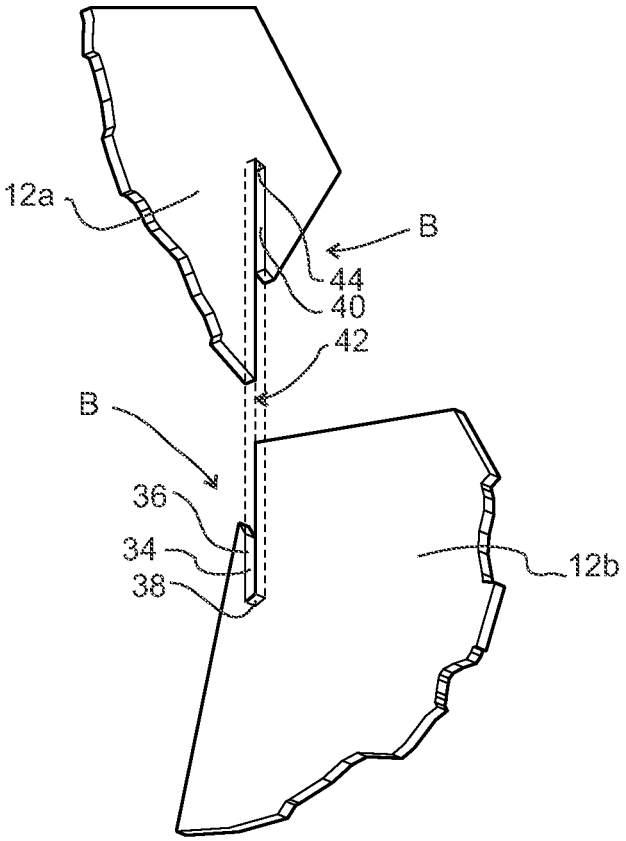
FIG. 6 is an exploded detail view of a first joint formed by connecting first and second panels.

Referring now to FIGS. 1A and 6, the second connector 34 and third connector 40 of each planar panel 12*a*, 12*b*, 12*c* can mechanically engage with one another to define a three dimensional geometric shape. The second slot 36 of the second connector 34 (vertex B) of the first planar panel 12*a* can slidably engage the third slot 42 of the third connector 40 (vertex B) of the second planar panel 12*b*. The second slot 36 of the second connector 34 (vertex C) of the second planar panel 12*b* can slidably engage the third slot 42 of the third connector 40 (vertex C) of the third planar panel 12*c*. The second slot 36 of the second connector 34 (vertex A) of the third planar panel 12*c* can slidably engage the third slot 42 of the third connector 40 (vertex A) of the first planar panel 12*a*. The second blind ends 38 of each of the second slots 36 can be brought into a position to abut the third blind end 44 of the third slot 42 to mechanically interconnect the first planar panel 12*a*, the second planar panel 12*b*, and the third planar panel 12*c* with respect to one another. A first joint is formed and defined at the intersection of each planar panel and an adjacent planar panel as best seen in FIG. 2A. In other words, a first joint can be formed with the second slot 36 of each of the first, second, and third planar panels 12*a*, 12*b*, 12*c* operatively engaging with the third slot 42 of another one of the first, second and third planar panels 12*a*, 12*b*, 12*c* to define at least one substantially tetrahedron-shaped 62 assembled modular sub-structure.

Figure 7:
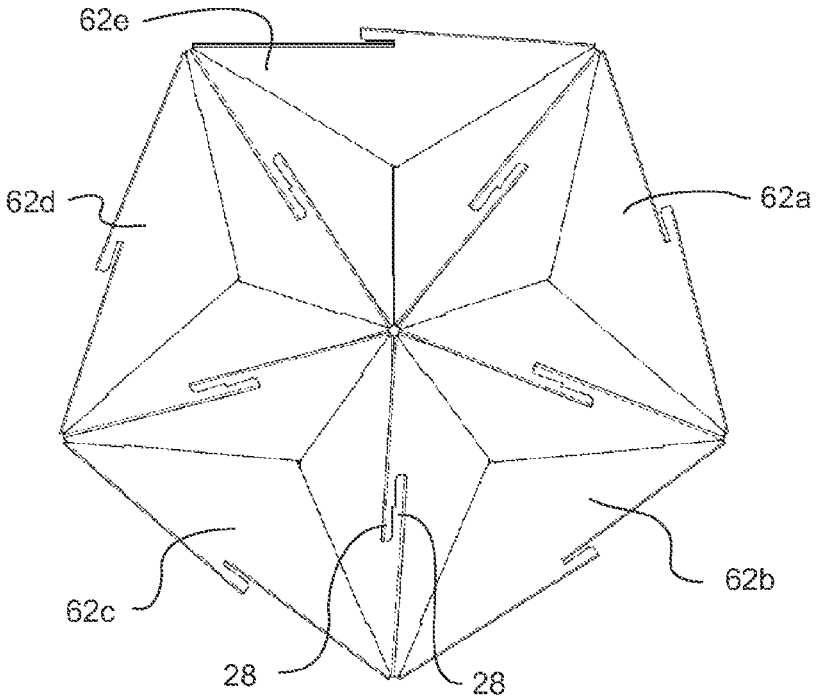
FIG. 7 is a perspective view of an assembled generally pentagonal shaped structure formed of first, second, third, forth, and fifth assembled generally tetrahedron-shaped modular structures as illustrated in FIGS. 2A-2C, where the tetrahedron-shaped modular structures are formed from a plurality of irregular panels.
Figure 10B:
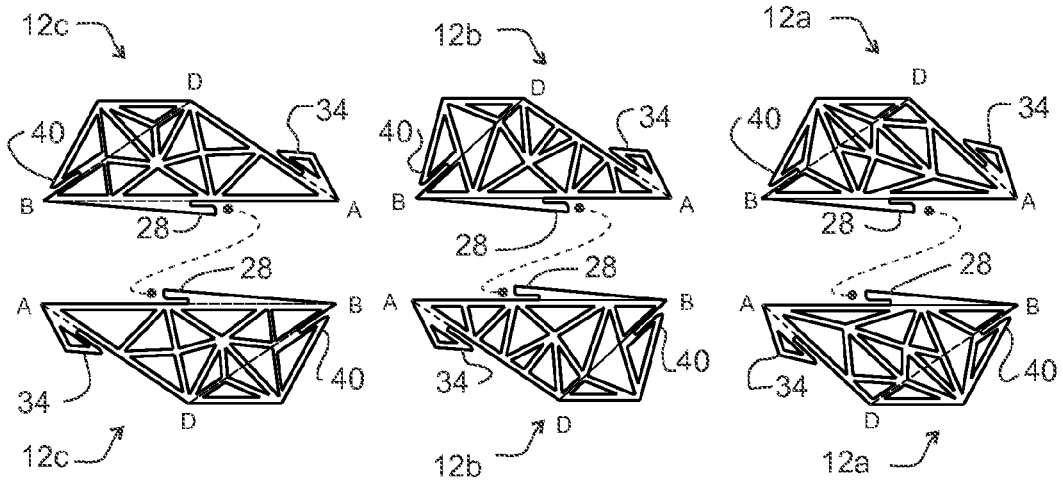
FIG. 10B illustrates a method or process for assembling panels to one another through interconnection of the first connectors.

Referring to FIGS. 1A and 7, the kit can further include five irregular module sub-structures 62*a*, 62*b*, 62*c*, 62*d*, and 62*e*. A second joint can be defined by two first slots 30 of each of the irregular module sub-structures slidably engaging with two first slots 30 of adjacent irregular module sub-structures as best shown in FIG. 10B. The first blind ends 32 can abut one another to form a substantially pentagon-shaped assembled modular sub-structure 74. The second sliding joint can be formed by slidably engaging the first connector 28 and first slot 30 of a first irregular module sub-structure 62*a* with the first connector 28 and first slot 30 of an adjacent second irregular module sub-structure 62*b*, 62*c*, 62*d*, and 62*e*. The first blind end 32 of the first slot 30 of the first irregular module sub-structure 62*a* can abut the first blind end 32 of the first slot 30 of the second irregular module sub-structure 62*b*, 62*c*, 6*d*, and 62*e*. The first slot 30 of one irregular tetrahedron-shaped assembled module sub-structure can be substantially filled with the first connector 28 of another irregular tetrahedron-shaped assembled module sub-structure. In the assembled relationship, a portion of the first connector 28 of one sub-structure can overlie the adjacent first connector 28 of another sub-structure. In this way, the first module structure 62*a* and the second through fifth module structures 62*b*, 62*c*, 62*d*, 62*e* are connectable with respect to one another to form an assembled pentagonal shaped structure 74.

Referring to FIG. 8, the at least one assembled pentagonal shaped structure 74*a* can further include a plurality of pentagonal shaped structures 74*a* and 74*b* mechanically interconnected to one another to form a larger modular structure 80. The at least one assembled larger modular structure 80 can be at least one of a substantially dome shaped structure and a substantially egg shaped structure enclosing an open space or a cavity (not shown). Alternatively, the at least one assembled larger modular structure 80 can be of virtually any three-dimensional shape as desired with a cavity being optionally defined.

The kit can further include a first, a second, and a third planar panel 12*a*, 12*b*, and 12*c*. Each planar panel can have at least three sides. A kit 10 for building a structural shape can include a planar panel 12. The planar panel 12 can have at least three sides. The first side 14 can include a straight edge with a first end 16 and a second end 18. The second side 20 can be connected to the first end 16 and extend from the first side 14 at a first predetermined angle 22. The third side 24 can be connected to the second end 16 and extend from the first side 14 at a second predetermined angle 26.

The kit can further include a first connector 28 integrally formed with the first side 14 and defining a first slot 30 between the first side 14 and the first connector 28. The first slot 30 can have a first blind end 32 substantially located at the midpoint of the first side 14. The first slot 20 can be defined to be substantially parallel to the first side 14.

The kit can further include a second connector 34 integrally formed with the second side 20 defining a second slot 36. The second slot 36 can have a second blind end 38 between the second side 20 and the second connector 34. The second slot 36 can be defined to be substantially parallel to the second side 20.

The kit can further include a third connector 40 integrally formed with the third side 24 defining a third slot 42. The third slot 40 can have a third blind end 44 between the third side 24 and the third connector 40. The third slot 42 can be defined to be substantially parallel to the third side 24.

The second connector 34 and third connector 40 of each planar panel 12*a*, 12*b*, 12*c* can mechanically engage with one another to define a three dimensional geometric shape, where the second slot 36 defined by the second connector 34 of the first planar panel 12*a* slidably engages the third slot 42 defined by the third connector 40 of the second planar panel 12*b* to define a first joint. The second slot 36 defined by the second connector 34 of the second planar panel 12*b* slidably engages the third slot 42 defined by the third connector 40 of the third planar panel 12*c* to define another first joint. The second slot 36 defined by the second connector 34 of the third planar panel 12*c* slidably engages the third slot 42 defined by the third connector 40 of the first planar panel 12*a* to define another first joint. The second blind ends 38 of each of the second slots 36 can abut the third blind end 44 of the third slot 42 to mechanically interconnect the first planar panel 12*a*, the second planar panel 12*b*, and the third planar panel 12*c* with respect to one another through three first joints. The first joint can be defined at the intersection of each planar panel and an adjacent planar panel. In other words, the first joint can be formed with the second slot 36 of each of the first, second, and third planar panels 12*a*, 12*b*, 12*c* operatively engaging with a corresponding third slot 42 of another one of the first, second and third planar panels 12*a*, 12*b*, 12*c* to define at least one regular or irregular substantially tetrahedron-shaped 62 assembled modular sub-structure.

The at least one irregular module structure 62 can further include first 62*a*, second 62*b*, third 62*c*, fourth 62*d*, and fifth 62*e* module structures 62. The first connectors 28 of the first through fifth module sub-structures can mechanically engage one another to define a second joint. One of the first blind ends 32 of one of the first slots 30 of the first sub-structure can abut one of the first blind ends 32 of another one of the first slots 30 of an adjacent sub-structure. The first irregular module structure 62*a* and the adjacent irregular module structures 62*b*-62*e* are connectable with respect to one another through ten second joints to form at least one substantially pentagonal shaped structure 74.

The at least one substantially pentagonal shaped structure 74 can further include a first 74*a* and a second 74*b* substantially pentagonal shaped structures 74. The first slot 28 defined by the first connector 30 of the first substantially pentagonal shaped structure 74*a* can slidably engage the first slot 30 defined by the first connector 28 of the second substantially pentagonal shaped structure 74*a* to define a second joint. The first blind end 32 of each of the first slots 28 can abut the first blind end 32 of the first slot 30 to mechanically interconnect the first substantially pentagonal shaped structure 74*a* and second substantially pentagonal shaped structure 74*b* to form at least one modular superstructure 80.

The at least one modular superstructure 80 can be substantially dome or egg shaped. Alternatively, the at least one modular structure 80 can be of virtually any three-dimensional shape as desired. A superstructure or modular structure 80 can be formed by using planar panels 12 of different dimension from the straight first edge or side 14 to the opposite edge or side while constructing sub-structures or modules 62, 74 for use along a particular horizontal row located at a different particular elevation of the superstructure being built. The at least one modular superstructure 80 can be substantially rectangular, square, trapezoidal, spherical, pyramidal, rhomboidal, or of any other suitable shape and dimension. It should be recognized by those skilled in the art that using different dimension planar panel 12 and different edge boundaries between the second and third sides 20, 24 can provide varying dimension building blocks or sub-structures and different aesthetic appearances as desired.

One of ordinary skill in the art will appreciate that in use and in practice, the individual planar panels 12, the individual substantially tetrahedron shaped module sub-structures 62, the individual substantially pentagon shaped module structures 74, and the individual modular superstructures 80 can provide a myriad of applications and uses. The invention disclosed herein can provide application and use as an aesthetic structure, a load-bearing structure, or a number of other situations. Additionally, one of ordinary skill in the art will appreciate the ease and simplicity of packing individual panels 12 onto another for ease of transport or shipping prior to the construction of a structure, or after deconstruction of a structure.

Referring to FIGS. 2A-2C, and 9A-9C, the tetrahedron structure 62, 62*a*, 62*b*, and 62*c* is a reference shape for designing the panels 12 and module 80. The tetrahedron structure 62*a*, 62*b*, and 62*c* is a three sided pyramid and does not have to be regular or symmetrical in shape. The design of each module is based on the location of vertices in a tetrahedral arrangement. Vertices (also known as corners) are the points of the triangular faces of each panel that adjoin to form a tetrahedron. There can be four vertices A, B, C, and D in a tetrahedron 62, 62*a*, 62*b*, and 62*c*. In other words, the tetrahedron is made out of three planar panels that connect at and share vertices A, B, C, and D with one another. The vertices and edges of the panels 12 define the boundaries between the tetrahedron. Three of the vertices, A, B, and C, will always lie in the same plane, i.e. the vertices define a flat plane with the three points A, B, C. The forth vertex D is located somewhere else in space, anywhere but on the plane defined by the vertices A, B, C. The plane defined by the vertices A, B, C is the open face shown in FIGS. 2A-2C of the assembled tetrahedron, in that there is no planar panel component. The interlocking planar panels can lay oriented along the plane of the other three panels in the tetrahedron: A-C-D; C-B-D; and A-B-D.

Each planar panel 12*a*, 12*b*, and 12*c* is flush with the adjacent planar panel 12*a*, 12*b*, and 12*c* in the same plane of the slot geometry, or tetrahedral reference lines, which define how the panels 12*a*, 12*b*, and 12*c* relate and connect to each other. All of the connectors 28, 34, and 40 in the panels 12*a*, 12*b*, and 12*c* are related to each other through the intersection of the three panels relating to this tetrahedral slotting geometry. The slots 30, 36, 42 have a connector 28, 34, and 40 touching the outside of the adjacent panel 12*a*, 12*b*, and 12*c* and the dimensions of each slot 30, 36, 42 are such that they can hold the width of another planar panel. The reference lines define the angle at which the slots are arranged, with one connector connectors 28, 34, and 40 touching the reference line and other offset outside to accommodate the thickness of the panel. The slots 30, 36, 42 lie parallel to the respective reference line that connects vertex D to vertices A, B, C.

It should be noted that one surface defining an edge of the slot 30, 36, 42 is located on a reference line relating the vertices, while the slot is not centered to the reference line. This allows the panels 12 to bypass each other in forming a stable structure 62, 74, 80. The inside surface of a panel 12, when the panel is assembled to other panels to form part of the tetrahedron module, will be flush with the plane of that face. Edges of each panel touch in places other than the slot in order to hold the assembly of panels together, so the individual slots and connectors are not taking all the weight. The connectors 28, 34, 40 can be flared at the non-blind end to ease joining of steep angles or more rigid materials. It should further be noted that a plurality of connectors 28, 34, 40 can be provided along the first edge 14 if desired, as long as a length of the edge 14 is divided equidistantly with lengths between the blind ends of connectors 28, 34, 40.

Referring to FIGS. 9A, 9B, 10A, and 10B, modules 62 or superstructures 80 can be either regular or irregular, and can be fit together to form any triangular network as long as the vertices are contiguous. In other words, where the panels share edges and vertices, such that mapping the A, B, C vertices of the modules to the vertices of the panels in the network of the desired form, means the first connector in each module can be congruent with respects to vertices, edges, and connectors, so the shapes are an adjoined network of the open face at panel A, B, C. The modules allow construction of platonic solid shapes, such as the tetrahedron 62 which is the basis for the three panel module and the building of larger shapes with a plurality of tetrahedron modules, like a dodecahedron.

If the surface of a desired shape can be divided into adjoining panels of any dimension, as long as the vertices correspond to each other, the surface of the shape can be recreated with interlocking tetrahedral modules 62*a*, 62*b*, 62*c*. Adjoining modules do not have to be of the same dimensions. Adjoining modules only need to have the same length along the side where the adjoining modules touch and join together to form a larger structure. This means that irregular and regular tetrahedral modules of varied dimensions can be combined, if desired.

As should be recognized by those skilled in the art, this gives rise to use of the present invention, from kits with repeating panels to relevant contemporary digital fabrication techniques, where technology is used to create cut schedules for the manufacture and assembly of many unique pieces. Modules can be constructed from identical panels or dissimilar panels, from regular shapes and irregular shapes. The pentagon module superstructure is based on an assembly of five irregular tetrahedron modules. A hexagonal module can also be constructed from regular tetrahedron modules. A dodecahedron module is constructed from irregular shaped tetrahedron modules.

While the invention has been described in connection with what is presently considered to be the most practical embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A kit (10) for building a structural shape comprising:

first and second planar panels, each panel having at least three sides, including a first side (14) having a straight edge with a first corner (16) and a second corner (18), a second side (20) connected to the first corner (16) and extending from the first side (14) at a first predetermined angle (22), and a third side (24) connected to the second corner (18) and extending from the first side (14) at a second predetermined angle (26);

a first connector (28) integrally formed with the first side (14) and defining a first slot (30) between the first side (14) and the first connector (28) having a first blind end (32), with the first slot (30) substantially parallel to the first side (14), and the first slot (30) having the first blind end (32) facing away from the second corner (18) and the first connector (28) having a straight edge between the second corner (18) and an outer tip (28*a*) of the first connector (28);

a second connector (34) integrally formed with the second side (20) defining a second slot (36) having a second blind end (38) between the second side (20) and the second connector (34), with the second slot (36) substantially parallel to the second side (20), and the second slot (36) having the second blind end (38) facing away from the first corner (16);

a third connector (40) integrally formed with the third side (24) defining a third slot (42) having a third blind end (44) between the third side (24) and the third connector (40), with the third slot (42) substantially parallel to the third side (24), and the third slot (42) having the third blind end (44) facing toward the second corner (18); and each of the first slot (30), second slot (36) and third slot (42) slidably engageable with another planar panel.

2. The kit of claim 1, wherein the at least one planar panel (12) further comprises:

a first planar panel (12*a*) and a second planar panel (12*b*), and wherein at least one of the second connector (34) and third connector (40) of each planar panel (12*a*, 12*b*) mechanically engage with one another to define a three dimensional geometric shape, wherein the second slot (36) defined by the second connector (34) of the first planar panel (12*a*) operably engages with the third slot (42) defined by the third connector (40) of the second planar panel (12*b*) to define a first joint.

3. The kit of claim 1, wherein the at least one planar panel (12) further comprises:

a first planar panel (12*a*), a second planar panel (12*b*), and a third planar panel (12*c*), wherein the second connector (34) and third connector (40) of each planar panel (12*a*, 12*b*, 12*c*) mechanically engage with one another to define a three dimensional geometric shape, wherein the second slot (36) defined by the second connector (34) of the first planar panel (12*a*) operably engages the third slot (42) defined by the third connector (40) of the second planar panel (12*b*) to define a first joint, the second slot (36) defined by the second connector (34) of the second planar panel (12*b*) operably engages the third slot (42) defined by the third connector (40) of the third planar panel (12*c*) to define another first joint, and the second slot (36) defined by the second connector (34) of the third planar panel (12*c*) operably engages the third slot (42) defined by the third connector (40) of the first planar panel (12*a*) to define another first joint, such that the second blind ends (38) of each of the second slots (36) abut the third blind ends (44) of each of the third slots (42) to mechanically interconnect the first planar panel (12*a*), the second planar panel (12*b*), and the third planar panel (12*c*) with respect to one another through three first joints.

4. The kit of claim 1 further comprising:

a surface area (52) bounded by the first side (14), the second side (20), and the third side (24).

5. The kit of claim 4, wherein the surface area (52) is a lattice structure (54) defining a plurality of apertures (56).

6. The kit of claim 1, wherein the at least one planar panel (12) further comprises a first planar panel (12*a*) and a second planar panel (12*b*), the second connector (34) defined by the first planar panel (12*a*) connectable to the third connector (40) defined by the second planar panel (12*b*), wherein the first connector (28) defined the first planar panel (12*a*) slidably connects to the first connector (28) defined by the second planar panel (12*b*) to define a second joint.

7. The kit of claim 1, further comprising:

a fourth side (60) extending between the second side (20) and the third side (18).

8. The kit of claim 1, wherein the first predetermined angle (22) ranges from between about 10 degrees to about 160 degrees, inclusive.

9. The kit of claim 1, wherein the first predetermined angle (22) ranges from between about 20 degree to about 120 degrees, inclusive.

10. The kit of claim 1, wherein the second predetermined angle (26) ranges from between about 10 degrees to about 160 degrees, inclusive.

11. The kit of claim 1, wherein the second predetermined angle (26) ranges from between about 20 degrees to about 120 degrees, inclusive.

12. A kit (10) for building a structural shape comprising:

a first, a second and a third planar panel (12*a*, 12*b*, 12*c*), each planar panel having at least three sides, including a first side (14) having a straight edge with a first corner (16) and a second corner (18), a second side (20) connected to the first corner (16) and extending from the first side (14) at a first predetermined angle (22), and a third side (24) connected to the second corner (18) and extending from the first side (14) at a second predetermined angle (26);

a first connector (28) integrally formed with the first side (14) and defining a first slot (30) between the first side (14) and the first connector (28) having a first blind end (32), with the first slot (30) substantially parallel to the first side (14), and the first slot (30) having the first blind end (32) facing away from the second corner (18) and the first connector (28) having a straight edge between the second corner (18) and an outer tip (28*a*) of the first connector (28);

a second connector (34) integrally formed with the second side (20) defining a second slot (36) having a second blind end (38) between the second side (20) and the second connector (34), with the second slot (36) substantially parallel to the second side (20), and the second slot (36) having the second blind end (38) facing away from the first corner (16); and a third connector (40) integrally formed with the third side (24) defining a third slot (42) adjacent the second corner and having a third blind end (44) between the third side (24) and the third connector (40), defining the third slot (42) between the third side (24) and the third connector (40), with the third slot (42) substantially parallel to the third side (24), and the third slot (42) having the third blind end (44) facing toward the second corner (18), wherein the first connector (28), the second connector (34), and the third connector (40) mechanically engage with respect to one another to define a first joint formed with the second slot (36) of each of the first, second, and third planar panels (12*a*, 12*b*, 12*c*) operatively engaging with the third slot (42) of another one of the first, second and third planar panels (12*a*, 12*b*, 12*c*) to define at least one substantially tetrahedron-shaped (62) assembled modular sub-structure.

13. The kit of claim 12 further comprising:

five of the substantially tetrahedron-shaped (62) assembled modular sub-structures; and a second joint defined by the first slot (30) of one of the substantially tetrahedron-shaped (62) assembled modular sub-structures operably engaging with the first slot (30) of another one of the substantially tetrahedron-shaped (62) assembled modular sub-structures, such that the first blind ends (32) of each first slot (30) abut one another, the five substantially tetrahedron-shaped (62) assembled modular sub-structures connected to one another through five second joints to form a substantially pentagon-shaped assembled modular sub-structure (74).

14. The kit of claim 12, wherein the first predetermined angle (22) ranges from between about 10 degrees to about 160 degrees, inclusive.

15. The kit of claim 12, wherein the second predetermined angle (26) ranges from between about 10 degrees to about 160 degrees, inclusive.

16. The kit of claim 12, wherein a surface area (52) is bounded by the first side (14), the second side (20), and the third side (24).

17. The kit of claim 12, wherein first and second module sub-structures, each module sub-structure further comprises:

a first module sub-structure (62*a*) and a second module sub-structure (62*b*), wherein the first connectors (28) of the first and second module sub-structures mechanically engage one another, such that the first blind ends (32) of the first slots (30) abut one another to define a second joint, such that the first module structure (62*a*) and the second module structure (62*b*) are connectable with respect to one another through the second joint.

18. The kit of claim 17, wherein the at least one assembled modular structure further comprises a plurality of tetrahedron-shaped assembled modular structures (62*a*-62*e*) assembled to define a plurality of pentagonal shaped structures, the plurality of pentagonal shaped structures mechanically interconnected to one another through second joints defined by interconnected first slots (30) to form an assembled modular superstructure.

19. The kit of claim 17, wherein the at least one assembled modular structure (80) is at least one of a substantially dome shaped structure, a substantially egg shaped structure, and a three-dimensional structure.

20. A kit (10) for building a structural shape comprising:

at least a first, a second and a third planar panel (12*a*, 12*b*, 12*c*), first, second and third planar panels (12*a*, 12*b*, 12*c*), each panel having at least three sides, including a first side (14) having a straight edge with a first corner (16) and a second corner (18), a second side (20) connected to the first corner (16) and extending from the first side (14) at a first predetermined angle (22), and a third side (24) connected to the second corner (18) and extending from the first side (14) at a second predetermined angle (26), wherein the first and second predetermined angles (22, 26) range from between 10 degrees to 160 degrees, inclusive;

a first connector (28) integrally formed with the first side (14) and defining a first slot (30) between the first side (14) and the first connector (28) having a first blind end (32), with the first slot (30) substantially parallel to the first side (14), and the first slot (30) having the first blind end (32) facing away from the second corner (18) and the first connector (28) having a straight edge between the second corner (18) and an outer tip (28*a*) of the first connector (28);

a second connector (34) integrally formed with the second side (20) defining a second slot (36) having a second blind end (38) between the second side (20) and the second connector (34), with the second slot (36) substantially parallel to the second side (20), and the second slot (36) having the second blind end (38) facing away from the first corner (16);

a third connector (40) integrally formed with the third side (24) defining a third slot (42) adjacent the second corner and having a third blind end (44) between the third side (24) and the third connector (40), defining the third slot (42) between the third side (24) and the third connector (40), with the third slot (42) substantially parallel to the third side (24), and the third slot (42) having the third blind end (44) facing toward the second corner (18), wherein the first connector (28), the second connector (34), and the third connector (40) of each of the first, second, and third planar panels (12*a*, 12*b*, 12*c*) can mechanically engage with respect to one another to define a first joint and the first connectors (28) of each of the first, second, and third planar panels (12*a*, 12*b*, 12*c*) can mechanically engage with respect to one another to define a second joint, wherein the first joint is formed with the second slot (36) of one of the first, second, and third planar panels (12*a*, 12*b*, 12*c*) operatively engaging with the third slot (42) of another of the first, second and third planar panels (12*a*, 12*b*, 12*c*), and wherein the second joint is formed with the first slot (30) of one of the first, second, and third planar panels (12*a*, 12*b*, 12*c*) operably engaging with the first slot (30) of another one of the first, second, and third planar panels (12*a*, 12*b*,

12*c*), such that the first blind end (32) of the first slot (30) abuts the first blind end (32) of the first slot (30) of another one of the first, second, and third planar panels (12*a*, 12*b*, 12*c*), such that the first planar panel (12*a*), the second planar panel (12*b*), and the third planar panel (12*c*) are connectable with respect to one another through three first joints to form at least one module structure (62);

wherein the at least one module structure (62) further comprises five module structures (62*a*, 62*b*, 62*c*, 62*d*, 62*e*), wherein the first slot (28) defined by the first connector (30) of one of the module structures (62*a*, 62*b*, 62*c*, 62*d*, 62*e*) operably engages the first slot (30) defined by the first connector (28) of another one of the module structures (62*a*, 62*b*, 62*c*, 62*d*, 62*e*) to mechanically interconnect the five module structures (62*a*, 62*b*, 62*c*, 62*d*, 62*e*) with respect to one another through five second joints to form at least one substantially pentagonal shaped structure (74); and wherein the at least one substantially pentagonal shaped structure (74) further comprises a plurality of substantially pentagonal shaped structures (74*a*, 74*b*), wherein the first slot (30) defined by the first connector (28) of one of the plurality of pentagonal shaped structures (74*a*) operably engages the first slot (30) defined by the first connector (28) of another one of the plurality pentagonal shaped structure (74*b*) to mechanically interconnect at least six adjacent substantially pentagonal shaped structures (74*a*, 74*b*) to one another through ten second joints in order to form at least one assembled modular superstructure (80) defining a cavity.

* * * * *